United States Patent [19]

Bharucha et al.

[11] 3,941,669

[45] Mar. 2, 1976

[54] FLUIDIZED BED ELECTRODE SYSTEM

[75] Inventors: Nanabhai R. Bharucha, Beaconsfield; Pierre L. Claessens, Saint-Eustache, both of Canada

[73] Assignee: Noranda Mines Limited, Toronto, Canada

[22] Filed: May 1, 1974

[21] Appl. No.: 466,085

[30] Foreign Application Priority Data

Aug. 13, 1973 Canada ..... 178670

[52] U.S. Cl. ..... 204/105 R; 204/106; 204/108; 204/222; 204/277

[51] Int. Cl.[2].. C25C 1/12; C25C 1/22; C25C 17/12

[58] Field of Search ..... 204/283, 273, 261, 258, 204/284, 277, DIG. 10, 106, 108, 222, 105 R; 136/86 D

[56] References Cited

FOREIGN PATENTS OR APPLICATIONS 1,194,181 6/1970 United Kingdom ..... 204/284

OTHER PUBLICATIONS

"Applications of Fluidized Beds in Electrochemistry" by P. Le Goff et al., Industrial & Engineering Chem., Vol. 61 No. 10, 1969, pp. 8–17.

*Primary Examiner*—R. L. Andrews

*Attorney, Agent, or Firm*—Fleit & Jacobson

[57] ABSTRACT

A fluidized bed electrode system comprises an electrode chamber having a porous base, a main electrode consisting of a bed of fine solid particles contained in such chamber and selected from the group consisting of metals, metal coated glass beads and metal coated plastic beads, a current feeder extending into the bed, means for leading air or inert gas through the porous base at a predetermined velocity and pressure to fluidize the bed, and means for introducing a solution to be treated into the electrode chamber at a point above the porous base and for circulating such solution through the bed at a predetermined flow rate.

11 Claims, 3 Drawing Figures

FIG. 1
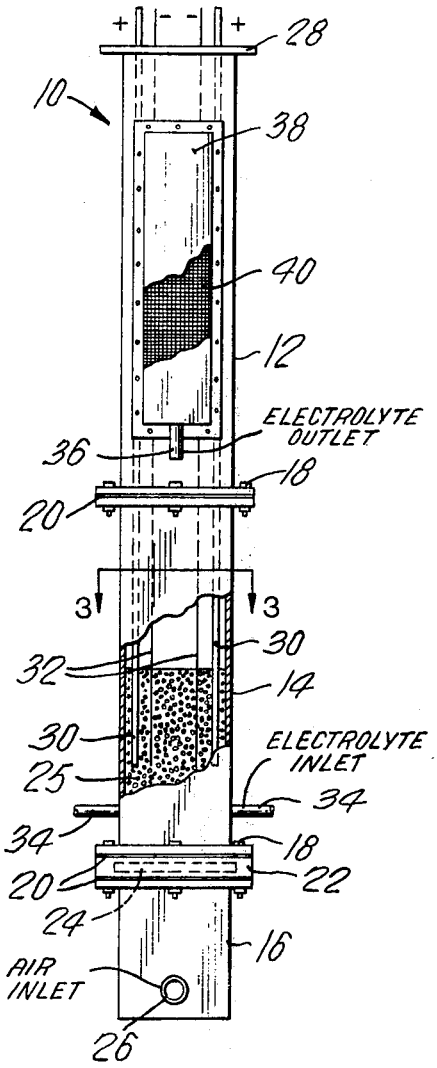
FIG. 2
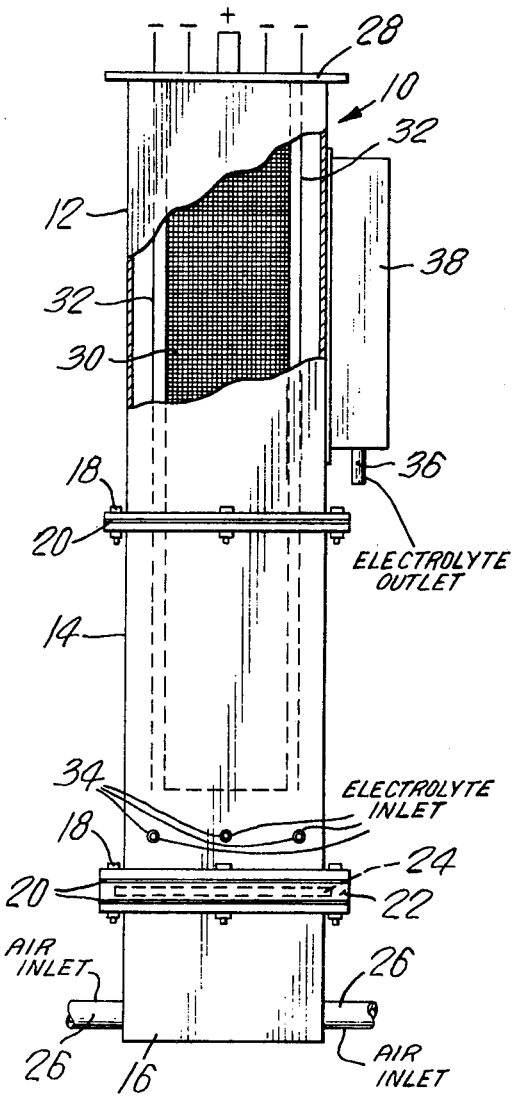
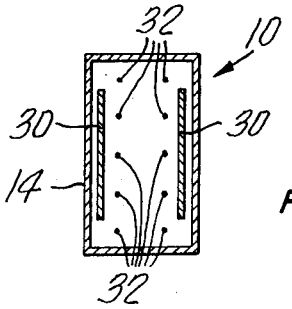
FIG. 3

FLUIDIZED BED ELECTRODE SYSTEM

This invention relates to a fluidized-bed electrode system and to a method for treating a solution by such fluidized-bed electrode system.

BACKGROUND OF THE INVENTION

The advantages of using fluidized-bed electrodes in various electrochemical processes such as electrowinning of metals from dilute solutions or electrosynthesis of organic materials are increasingly recognized. In the literature, the fluidized-bed electrode system is described as being basically composed of fine particles of metals or metal-coated glass or plastic beads contained in a suitably designed cell and fluidized by the passage of an electrolyte solution to be treated through the bed of particles. Electrical feeders in contact with the particulated bed and auxiliary electrodes complete the electrochemical circuit.

To obtain optimum performance from this type of fluidized-bed electrodes, it has been disclosed in the prior art that a bed expansion varying between 10 and 50% was necessary. To obtain bed expansions of these magnitudes, the electrolyte has to be circulated through the cell at a fixed flow rate depending mostly on the specific gravity of the electrolyte and of the particles to be fluidized, on the dimension of the particles and on the geometry of the cell. One important implication of this is that, to achieve any desired degree of completeness of an electrochemical reaction, that is complete removal of an ionic species from the electrolyte solution, it is often necessary to recirculate the solution through the fluidized-bed electrode cell or to mount plural cells in series. Another possible way of overcoming this problem is to increase the total height of the fluidized-bed electrode; however, this may lead to several difficulties in practice such as the necessity of introducing the electrolyte into the cell at a high pressure to overcome the pressure drop due to the weight of the particles composing the bed.

SUMMARY OF THE INVENTION

It is therefore the object of the present invention to provide a novel fluidized-bed electrode system permitting to obtain any desired degree of fluidization independently of the speed at which the electrolyte is circulated through the cell.

It is also the object of the present invention to provide a novel method of fluidizing the bed which permits to treat a solution or to effect selective removal of predetermined ionic species from a solution in a minimum number of passes through the bed and using a minimum number of cells in series.

The above objects of the invention are achieved, generally, by fluidizing the particulated bed solely by means of air or inert gas thus allowing one extra degree of freedom in the operation of the fluidized bed electrode cell.

The apparatus, in accordance with the invention, comprises an electrode chamber having a porous base, a main electrode consisting of a bed of fine solid particles contained in such chamber and selected from the group consisting of metals, metal coated glass beads and metal coated plastic beads, an auxiliary electrode located in such chamber and electrically insulated from the main electrode, a current feeder extending into such bed, means for leading air or inert gas through the porous base at a predetermined velocity and pressure to fluidize the bed, and means for introducing a solution to be treated through the fluidized bed at a point above the porous base and for circulating such solution at a predetermined flow rate.

The gas used to fluidize the bed may be air or other gases preferably inert.

The auxiliary electrode is normally made of lead or lead alloys, and such electrode may be insulated from the main electrode by means of a non conductive screen material preferably consisting of a synthetic organic fiber screen cloth partially impregnated into the conductive base material so as to permit direct introduction of the auxiliary electrode into the fluidized bed without any risk of short circuit. The synthetic organic fiber screen cloth may be selected from the group consisting of nylon, polyester, polyethylene, polypropylene and Teflon materials.

The method for treating a solution using the above disclosed fluidized-bed electrode consists in fluidizing such bed solely by leading air or inert gas through the porous base at a predetermined velocity and pressure to obtain a desired degree of fluidization, and introducing the solution through the fluidized bed at a point above the porous base and circulating such solution at a predetermined flow rate.

The solution to be treated may contain at least one metal which may be recovered by electrodeposition on the particles of the bed. The metal may also be recovered by a chemical reaction wherein the metal adheres poorly to the solid particles of the bed and subsequently flows out of the chamber with the solution. In such case, the metal is separated from the solution flowing out of the electrolytic cell by filtration or by any other suitable method.

BRIEF DESCRIPTION OF THE DRAWINGS

The invention will now be disclosed, by way of example, with reference to a preferred embodiment thereof illustrated in the accompanying drawings in which:

FIG. 1 illustrates a side view of a fluidized-bed electrode system in accordance with the invention:

FIG. 2 illustrates another side view of the fluidized-bed electrode system in accordance with the invention; and FIG. 3 illustrates a section taken through lines 3—3 of FIG. 1.

DETAILED DESCRIPTION

Referring to FIGS. 1–3, there is shown a typical fluidized-bed electrode system in accordance with the invention. The cell is composed of three housing sections 12, 14 and 16 secured together by any suitable means such as bolts 18 and sealed by gaskets 20. The housing may, of course, be made of a lower or higher number of sections depending on its size and also on the manufacturing facilities. The housing is normally made of an electrically non conductive material which is resistant to corrosion, or of metal coated with electrically non conductive material for electrical insulation purposes. A porous base support 22 is provided between sections 14 and 16 and such support is used to hold a porous plate 24 illustrated in dash lines and made of non conductive material such as polyethylene or polypropylene having a mesh size of not more than about half the size of the particles of the bed. The particulated bed 25 composing the fluidized main electrode is supported by the porous plate 24 and the particles of the bed are made of metal or metal coated glass or plastic beads varying preferably from 100–1000 microns in diameter depending upon the specific gravity of the particles. Fluidization of the bed is obtained through a gas which enters section 16 of the housing through air inlets 26. The housing is closed by a cover 28 which supports the auxiliary electrodes 30 and the current feeders 32 which are introduced into the fluidized bed electrode. The electrolytic solution to be treated is introduced into the cell through inlets 34 in the sides of the cell and flows out of the cell through outlets 36 located in the bottom of a small enclosure 38 communicating with the cell. A screen 40 separates the cell from the enclosure 38 for retaining the particles of the bed in the cell. The mesh size of the screen 40 should be less than half the diameter of the particles of the bed.

The auxiliary electrode 30 is connected to a source of positive potential whereas the current feeders are connected to a source of negative potential. The particles of the bed of the above-disclosed electrode system form the cathode of the cell. Of course, when such particles form the anode of the cell, the polarities are reversed.

The auxiliary electrode may take various configurations. Indeed, the fluidized-bed electrode cells disclosed in the literature present different forms in regard to the geometry and location of the anodes and cathodes such as, side by side, concentric or plane parallel. However, each of these configurations requires a minimum separation between the oppositely charged electrodes. To achieve the separation, a porous membrane is normally used as for example in the side by side and the concentric cells, or the auxiliary electrode is placed at a sufficient distance above the fluidized bed electrode as in the plane-parallel configuration.

The configuration disclosed in the present application, although not limited thereto, is the one of U.S. patent application Ser. No. 466,086 filed May 1, 1974. As illustrated more particularly in FIGS. 2 and 3, the auxiliary electrode is in a sheet form and made of lead or lead alloys. In addition, a non conductive screen material is pressure-impregnated into the surface of the auxiliary electrode. The non conductive screen material may be a screen cloth of a synthetic organic fiber material resistant to the electrolyte solution, such as nylon, polyester, polyethylene, polypropylene or Teflon. Care must be taken during impregnation to control the pressure so that the screen cloth is only about 50% pressed into the lead, so as to prevent the particles of the bed from contacting the lead or lead alloy composition of the auxiliary electrode. Usually, a pressure of 2500–3500 psi is sufficient to achieve a proper impregnation using pure lead auxiliary electrodes. The mesh opening of the cloths depends on the size of the particles of the fluidized bed but should not preferably be more than about half the size of the particles of the fluidized bed. The impregnated electrodes prepared in sheet form may further be worked to any reasonable shape by careful shaping so as to conform to the geometric requirements of the cell.

It has been found that the above disclosed auxiliary electrode permits the cell voltage to be lowered and consequently the power consumption of the cell. For example, using the impregnated auxiliary electrode disclosed above during copper electrowinning experiments from dilute solutions, power consumptions of 1.2–1.6 kWhr/lb were measured, while using the same electrolyte but with conventional (bare) electrodes placed above the bed the power consumption was 4.9 kWhr/lb.

The main advantage of the present invention is that, because the gas flow through the particulated bed provides the necessary bed fluidization characteristics, it is possible to introduce the electrolyte solution into the cell at any convenient flow rate depending on the objectives of the operation. For example, if complete removal of an ionic species from a given electrolyte solution has to be carried out, the solution flow rate may be adjusted so that the complete removal can be achieved in one pass through the cell independently of the fluidized bed height or of the specific gravity and size of the particles. Moreover, the flow rate of the electrolyte solution can be adjusted during the operation to compensate for any change in concentration of the ionic species to be removed.

Another advantage of the gas fluidized-bed electrode system is that the electrolyte can be introduced into the cell without the necessity of passing it through the porous base. This eliminates the necessity of having an electrolyte solution free of fine suspended solids which could block the porous base as may be the case with particulated bed electrodes fluidized by the electrolyte solution.

In one example of electrolysis carried out with the fluidized bed electrode cell in accordance with the invention, a solution containing 1.7 gpl copper ions (as cupric sulfate) and 50 gpl sulfuric acid was passed through a fluidized bed electrode made of copper particles of about 130 microns. The cell was 2 inch thick, 4¾ inch wide and 14 inch high and the flow rate of the solution was 1.3 L/min. The fluidizing gas was air providing a bed expansion of about 30%. For a cell current of 200 amp and a cell voltage of 3–4 volts, the concentration of the solution at the outlet of this cell was 0.13 gpl copper corresponding to 92.4% removal of copper ions in one pass of the electrolyte through the fluidized-bed electrode cell.

In another example, various acidic dilute solutions containing copper, tellurium and selenium were passed through another cell in accordance with the invention (3½ inch thick, 6 inch wide and 40 inch high). The various parameters of the cell are illustrated in the following Table:

TABLE

| Fixed Bed Height cm. | Cell Current amp. | Cell Voltage Volts | Solution Flow Rate L/min. | Cu Concentration gpl | Te Concentration gpl | Se Concentration gpl | Type of Solution |
|---|---|---|---|---|---|---|---|
| 28 | 250 | 8.0 | 1.0 | 0.19<br>0.28 | 0.36<br>0.04 | 0.26<br>0.12 | Acid Solution pH<0 |
| 20 | 250 | 20.0 | 1.0 | 0.03<br>0.02 | 0.06<br>0.02 | 0.05<br><0.01 | acidified solution pH 1.3 |
| 14 | 250 | 17.5 | 1.0 | 0.03 | 0.06 | 0.04 | acidified |

TABLE-continued

| Fixed Bed Height cm. | Cell Current amp. | Cell Voltage Volts | Solution Flow Rate L/min. | Cu Concentration gpl | Te Concentration gpl | Se Concentration gpl | Type of Solution |
|---|---|---|---|---|---|---|---|
| | | | | 0.02 | <0.01 | 0.01 | solution pH 1.3 |
| 25 | 250 | 17 | 1.5 | 0.03 | 0.05 | 0.04 | acidified |
| | | | | 0.02 | 0.01 | <0.01 | solution pH 1.3 |

The first line of each row is the original concentration of copper, tellurium and selenium, while the second line represents the concentration of copper, tellurium and selenium left in the dilute solution after one pass of the solution through the cell. It will be noted that the concentration of tellurium and selenium in all cases is greatly reduced. In the above examples, a chemical reaction is involved as follows:

$$4Cu + SeO_3^{2-} + 6H^+ \rightarrow CU_2Se + 2Cu^{2+} + 3H_2O$$
$$4Cu + TeO_3^{2-} + 6H^+ \rightarrow Cu_2Te + 2Cu^{2+} + 3H_2O$$

The copper telluride or copper selenide adheres poorly to the copper particles of the bed and subsequently flows out of the cell chamber through the screen 40. The copper telluride or selenide is then easily recovered from the solution by any suitable method such as filtration. The copper ions released during the chemical reaction are further electrochemically deposited onto the copper particles composing the fluidized bed cathode.

Although the invention has been disclosed with reference to a preferred embodiment thereof, it is to be understood that it is not limited to such embodiments. For example, the gas used for fluidizing the bed may be air or other gases preferably inert. Similarly, the fluidized-bed electrode system may find applications in methods of treating solutions which are other than the ones disclosed herein by way of example only.

What is claimed is:

1. A fluidized-bed electrode-system comprising:

a. an electrode chamber having a porous base;

b. a main electrode consisting of a bed of fine solid particles contained in said chamber, said solid particles being selected from the group consisting of metals, metal coated glass beads, and metal coated plastic beads;

c. an auxiliary electrode located in said chamber and electrically insulated from said main electrode;

d. a current feeder extending into said bed;

e. means for leading air or inert gas through said porous base at a predetermined velocity and pressure to fluidize said bed; and f. means for introducing a solution to be treated through said fluidized bed at a point above said porous base and for circulating said solution at a predetermined flow rate.

2. A fluidized-bed electrode system as defined in claim 1, wherein said auxiliary electrode is made of lead or lead alloys.

3. A fluidized-bed electrode system as defined in claim 2, wherein said auxiliary electrode is electrically insulated from said main electrode by means of a non conductive screen material partially impregnated in the lead or lead alloy so as to permit direct introduction of the auxiliary electrode into the fluidized bed without any risk of short circuit.

4. A fluidized-bed electrode system as defined in claim 3, wherein said non conductive screen material is a synthetic organic fiber screen cloth.

5. A fluidized-bed electrode system as defined in claim 4, wherein said non conductive screen cloth is selected from the group consisting of nylon, polyester, polyethylene, polypropylene and Teflon.

6. A fluidized-bed electrode system as defined in claim 2, wherein said auxiliary electrode has a sheet configuration.

7. A method for recovering a metal from a solution containing such metal using a fluidized-bed electrode system comprising an electrode chamber having a porous base, a main electrode located in such chamber and consisting of a bed of fine solid particles at least coated with metals, an auxiliary electrode insulated from said main electrode, and a current feeder extending into said bed, said method comprising the steps of:

a. fluidizing said bed solely by leading air or inert gas through the porous base at a predetermined velocity and pressure to obtain a desired degree of fluidization; and b. introducing said solution into the electrode chamber at a point above the porous base and circulating the solution through the fluidized-bed at a predetermined flow rate.

8. A method as defined in claim 7, wherein the solution to be treated contains at least one metal and wherein said metal is deposited on the particles of the bed.

9. A method as defined in claim 8, wherein said metal is copper.

10. A method as defined in claim 7, wherein the solution to be treated contains at least one metal and wherein such metal adheres poorly to the solid particles of the bed and subsequently flows out of the chamber with the solution, and further comprising the steps of separating the metal to be recovered from the solution.

11. A method as defined in claim 10, wherein the metals recovered are tellurium and selenium.

* * * * *